United States Patent [19]

Williams, III et al.

[11] Patent Number: 4,524,477

[45] Date of Patent: Jun. 25, 1985

[54] CLEANING SOLUTION DISPENSER ATTACHMENT FOR ROTARY FLOOR CLEANING MACHINE

[75] Inventors: Robert C. Williams, III, Raleigh; Stephen R. Williams, Cary, both of N.C.

[73] Assignee: U.S. Floor Systems, Inc., Raleigh, N.C.

[21] Appl. No.: 612,449

[22] Filed: May 21, 1984

[51] Int. Cl.[3] ..... B05B 15/06; A47L 11/34

[52] U.S. Cl. ..... 15/50 R; 15/246; 222/610

[58] Field of Search ..... 15/50 R, 50 RB, 50 C, 15/51, 52, 98, 320, 321, 246; 222/610, 611

[56] References Cited

U.S. PATENT DOCUMENTS

| | | | |
|---|---|---|---|
| 3,466,690 | 9/1969 | Cooper | 15/50 R |
| 4,138,760 | 2/1979 | Cadle | 15/321 |
| 4,432,472 | 2/1984 | Lamm | 15/50 R |

*Primary Examiner*—Edward L. Roberts

*Attorney, Agent, or Firm*—Mills & Coats

[57] ABSTRACT

The present invention relates to a cleaning solution dispenser attachment for a rotary floor cleaning machine that is adapted to dispense cleaning solution on demand as the floor cleaning machine is moved over an area. Cleaning solution dispenser attachment is designed to be detachably secured to various size motor housings of a rotary floor cleaning machine, and can be rotatively adjusted thereon such that a dispenser arm or jet tube that extends outwardly therefrom can be positioned at various locations around the motor housing.

10 Claims, 7 Drawing Figures

CLEANING SOLUTION DISPENSER ATTACHMENT FOR ROTARY FLOOR CLEANING MACHINE

FIELD OF INVENTION

The present invention relates to rotary floor cleaning machines and to attachments therefor, and more particularly to a cleaning solution dispenser attachment for rotary floor cleaning machines that are adapted to dispense cleaning solution on demand as the machine is moved over an area.

BACKGROUND OF INVENTION

Rotary floor cleaning machines are widely used to clean carpet. Typically such a floor cleaning machine includes a bonnet pad or scrubber placed under a drive block and the drive block is rotatively driven causing the bonnet to be rotatively driven in scrubbing contact with the underlying carpet while the machine is moved over a floor.

One approach to applying carpet cleaning solution to the carpet has been to dip and saturate the bonnet pad in a container containing the solution. After dipping, the bonnet is "rung out" and placed under the drive block and the cleaning operation then proceeds. From time to time during the cleaning process, the bonnet will be removed from underneath the drive block and dipped and saturated in the cleaning solution. Obviously this is time consuming and quite inefficient, not to mention the inconvenience and problems of actually handling the bonnet pad and dipping the same into the container of cleaning solution.

Another approach to applying the carpet cleaning solution involves actually spraying or dispensing carpet cleaning solution onto the carpet in a separate operation. This may even be used in conjunction with the bonnet scrubbing technique discussed above. This separate spraying or dispensing operation is also time consuming and inefficient because it essentially means that the total carpet cleaning operation is a two-step process.

In addition with the separate spraying technique, one finds that the cleaning solution is not always freshly applied to the carpet when the rotary floor cleaning machine reaches certain areas. Also with either of the basic techniques discussed hereinabove, it is often difficult to uniformly apply the carpet cleaning solution to the carpet during the cleaning process.

Therefore, there is a need for a simple and efficient floor cleaning solution dispenser attachment that can be easily and conveniently attached to a conventional rotary floor cleaning machine wherein the dispenser attachment is designed such that the same will fit floor machines with various size motor housings.

SUMMARY OF INVENTION

The present invention relates to a floor cleaning solution dispenser attachment that is particularly designed to fit and be mounted to the motor housing of a rotary floor cleaning machine. Particularly the dispenser attachment of the present invention is designed to fit various types and makes of floor machines wherein the size of the motor housing may vary.

In general the applicator attachment of the present invention includes a pump housing structure enclosing an electric pump having a dispensing arm extending outwardly from the housing. Adjustable connection means are provided with the pump housing structure for detachably securing the pump housing structure to the top portion of a motor housing structure forming a part of the rotary floor cleaning machine.

A cavity is formed within pump housing structure for receiving and holding a container which is adapted to contain the carpet cleaning solution to be dispensed. A switch is operatively connected to the pump means of the dispenser attachment and is appropriately mounted on the handle of the floor machine such that by actuating the same carpet cleaning solution may be dispensed or sprayed from the floor cleaning machine directly onto the underlying carpet on demand.

It is, therefore, an object of the present invention to provide a floor cleaning solution dispenser attachment for a rotary floor cleaning machine of the type having an electric motor housing wherein the dispenser attachment is designed such that it can be easily and quickly attached and detached to various size motor housings thereby enabling the attachment of the present invention to fit numerous types and makes of rotary floor cleaning machines.

A further object of the present invention resides in the provision of a floor cleaning solution dispenser attachment of the character referred to above that includes a solution container associated directly therewith.

Another object of the present invention is to provide a dispenser attachment of the character referred to above that includes a dispensing arm and nozzle projecting outwardly therefrom and wherein the dispenser attachment is designed such that the same can be rotatively adjusted about the electric motor housing of the floor machine such that the location and orientation of the dispenser arm and nozzle can be varied with respect to the floor cleaning machine.

It is also an object of the present invention to provide a dispenser attachment for a rotary floor cleaning machine of the character referred to above that can be easily and quickly attached and detached to a floor cleaning machine wherein, as pointed out above, the same dispenser attachment can be mounted to various size motor housings.

It is also an object of the present invention to provide a dispenser attachment for a floor cleaning machine of the character referred to above that includes control means mounted to a handle forming a part of said floor cleaner machine that enables cleaning solution to be dispensed by an operator on demand.

It is also an object of the present invention to provide a dispenser attachment for a floor cleaning machine of the type discussed hereinabove wherein the dispenser arm extending from the attachment includes means for yielding in response to the dispenser arm or line being hit by a wall or other type of object during a cleaning operation.

It is also an object of the present invention to provide a dispenser attachment for dispensing carpet cleaning solution wherein the attachment is designed to be mounted to a conventional rotary floor cleaning machine such that the actual cleaning and dispensing is performed simultaneously in the same operation thereby eliminating a pre-spray step.

In this same regard, another object of the present invention entails the provision of a carpet cleaning system that is very efficient inasmuch as the chemical cleaning solution is always freshly applied to the carpet during the actual cleaning operation.

A further object of the present invention resides in the provision of a carpet cleaning system of the character referred to above that enables the cleaning solution to be uniformly applied to the underlying carpet during the actual cleaning operation.

A further object of the present invention resides in the provision of a dispenser attachment for a rotary floor cleaning machine of the character referred to above wherein the dispenser attachment is provided with control means by which an operator of the machine may dispense carpet cleaning solution directly onto the carpet adjacent the floor cleaning machine during the actual cleaning operation in such a manner that the quantity of solution dispensed is controlled and not wasted.

Other objects and advantages of the present invention will become apparent from a study of the following description and the accompanying drawings which are merely illustrative of the present invention.

APPLICATOR ATTACHMENT FOR ROTARY FLOOR CLEANING MACHINE

With further reference to the drawings, the floor or carpet cleaning solution dispenser attachment is indicated generally by the numeral 30 (FIG. 2) and the same is adapted to be mounted on a conventional rotary floor cleaning machine, indicated generally by the numeral 10.

Figure 1:
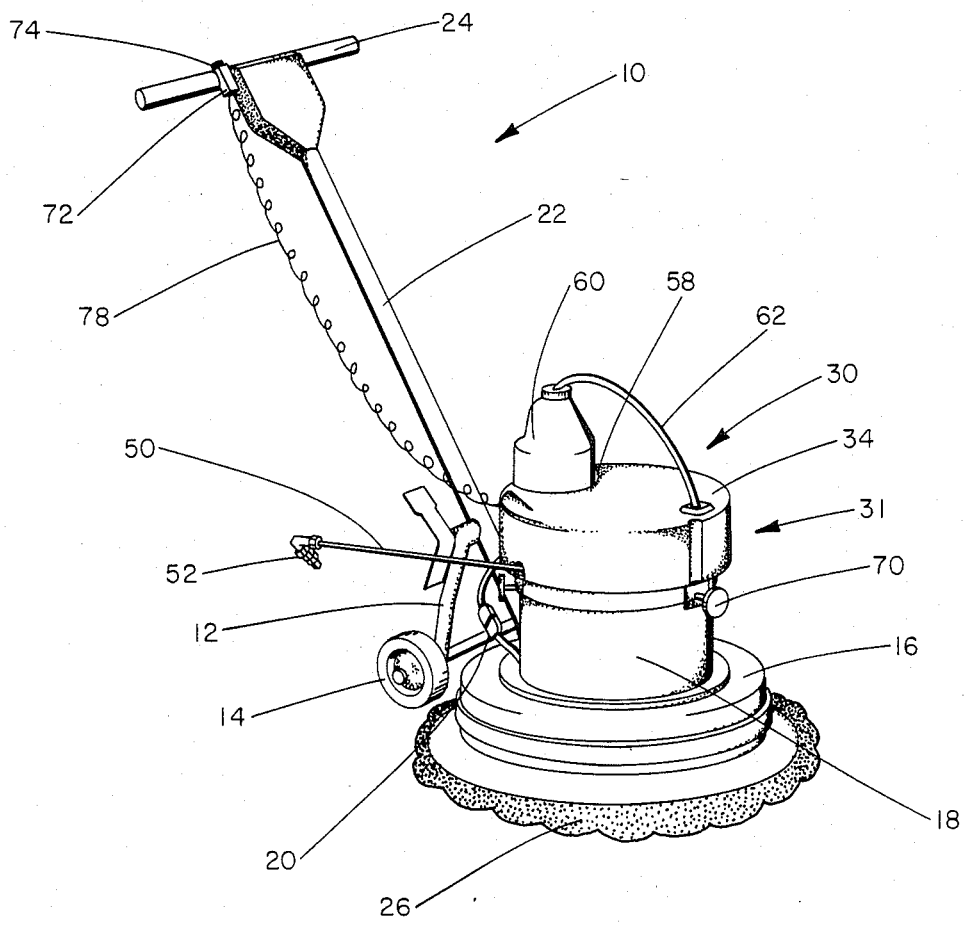
FIG. 1 is a perspective view of a conventional rotary floor cleaning machine with the floor cleaning solution dispenser attachment of the present invention mounted thereon.

Rotary floor cleaning machine 10 is particularly illustrated in FIG. 1 and is of a conventional design. Thus, a detailed discussion of the floor cleaning machine 10 will not be dealt with herein because such is not per se material to the present invention and further because such rotary floor cleaning machines are well known and appreciated in the art.

But for a more unified and complete understanding of the present invention, a brief description will follow discussing the basic elements of such a rotary floor cleaning machine 10. In this regard and with particular reference to FIG. 1, the rotary floor cleaning machine 10 includes a frame structure 12 having a pair of wheels 14 secured thereto. Secured to the frame structure 12 is a rotary drive system that is enclosed within a drive housing 16. Details of the rotary drive system are not shown herein but it should be pointed out that the same would include a block drive that is conventionally provided about the lower surface thereof with relatively stiff bristles. Operatively connected to the drive system is an electric motor (not shown) but is enclosed within an electric motor housing 18. As seen in FIG. 1, the floor machine 10 and electric motor is typically provided with an auxiliary electrical outlet 20.

Extending upwardly and to one side of the rotary floor cleaning machine 10 is a handle assembly that includes handle rod 22 and a handle 24.

In an operating mode, rotary floor cleaning machine 10 is designed to be disposed over a bonnet pad 26. To drive bonnet pad 26 in a rotary fashion, the drive block referred to above through the bristles thereon engage the bonnet pad 26 and as the drive block is driven the same acts to rotatively drive the bonnet pad.

Electric motor housing 18 extends over drive housing 16 and includes a generally cylindrical side wall structure and a generally flat top portion.

Now turning to a discussion of the dispenser attachment 30, it is seen that the same includes a pump housing structure indicated generally by the numeral 31. Pump housing structure 31 may be constructed of molded fiberglass or any other suitable material and includes a generally flat bottom 32 and an upper outer wall structure 34.

Figure 3:
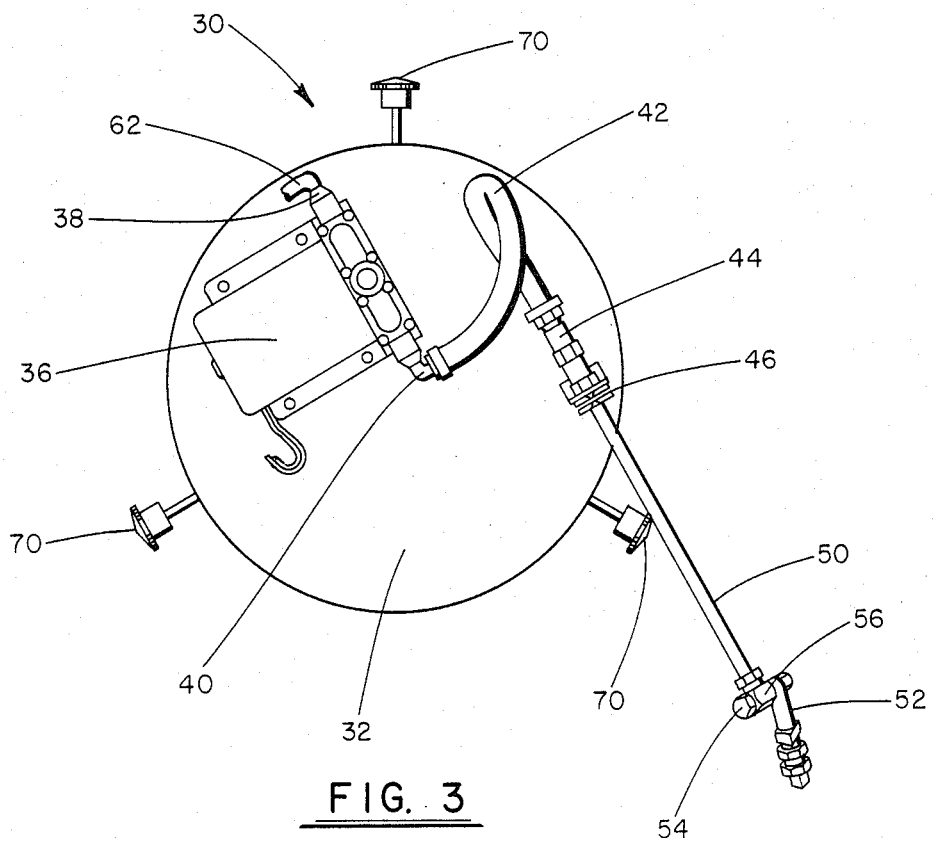
FIG. 3 is a top plan view of the dispenser attachment of the present invention with the upper outer wall of the housing structure removed to illustrate the dispenser's pump means and associated structure.
Figure 7:
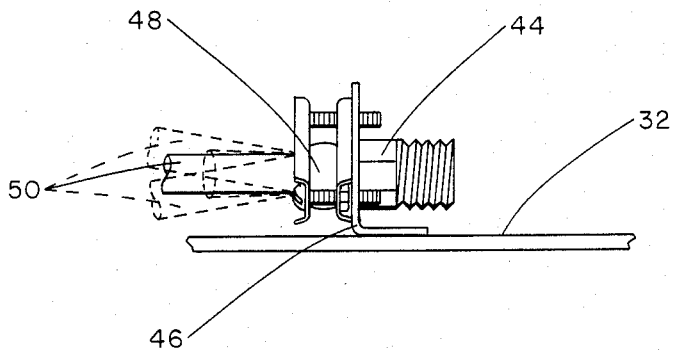
FIG. 7 is a fragmentary side elevational view illustrating a ball joint connector utilized to mount the dispenser arm or jet line to the pump housing structure of the dispenser attachment.

As illustrated in FIG. 3, pump means 36 is mounted to bottom 32. The pump means includes a positive displacement electrical pump that in the present disclosure has a capacity of approximately 0.18 gallons per minute. It is appreciated that the capacity of the pump could vary depending on the capacity desired and the particular application involved. As seen in FIG. 3, pump means 36 includes an inlet 38 and an outlet 40. Communicatively connected to outlet 40 is a flexible line 42 that leads to a coupler that is held and secured by a bracket 46 which is in turn mounted to the bottom 32 of pump housing structure 31 (FIG. 7).

Operatively connected to the remote end of coupler 44 is a ball joint connector 48 that is in turn operatively connected to a jet tube or dispenser arm 50. As particularly illustrated in FIG. 7, it is seen that the dispenser arm 50 can flex in a universal manner via ball joint connector 48. This ball joint connector 48 acts as a shock absorber inasmuch as the dispenser arm 50 can flex and move in response to the same coming in contact with a door jam or other immovable object during the course of cleaning.

Figure 2:
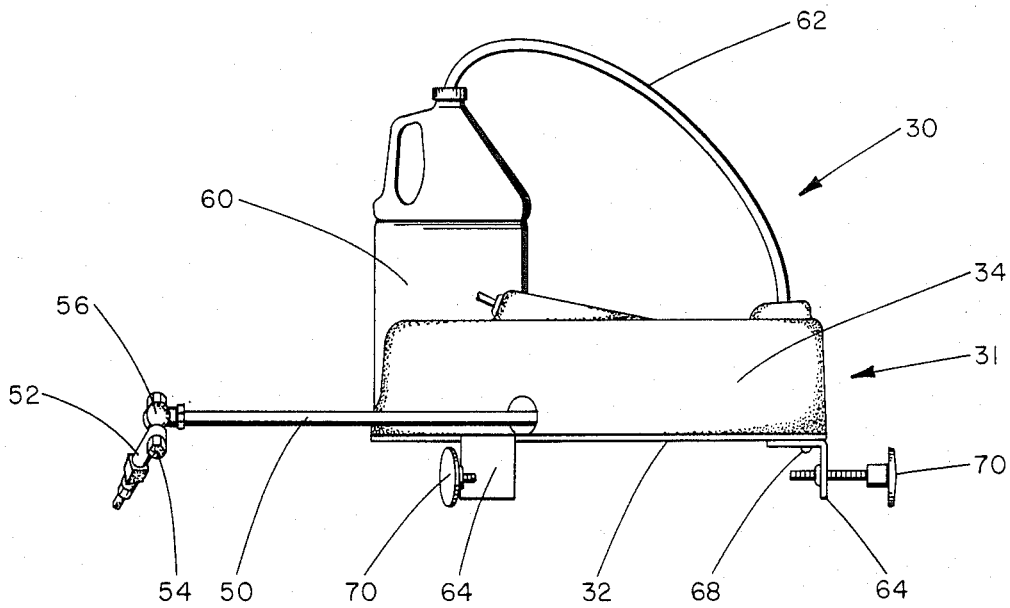
FIG. 2 is a side elevational view of the dispenser attachment of the present invention.

As seen in FIGS. 2 and 3, dispenser arm 50 extends outwardly from the pump housing structure 31. About an outer remote end thereof is secured a spray nozzle head 54. Spray nozzle head is pivotably connected by a pivot connector assembly 54 to a coupling joint 56. This connection arrangement allows spray nozzle head 54 to be adjusted in two planes since the same can rotate about the axis of pivot connector assembly 54 since coupling joint 56 can rotate about the elongated axis of dispenser arm 50.

Formed within the upper outer wall structure 34 of pump housing structure 31 is a container receiving cavity 58 which is adapted to receive, hold and support a solution container 60. Extending from solution container 60 is a connecting line 62 which is communicatively connected to inlet 38 of pump means 36.

Pump housing structure 31 is provided with adjustable connection means for allowing the same to be connected to various types and sizes of motor housings 18. In addition as will be understood from subsequent portions of this disclosure, the adjustable connection means allows pump housing structure 31 to be rotatively adjusted about the top of motor housing 18 to particularly position and orient dispenser arm 50 with respect to the rotary floor cleaning machine 10. Therefore, it is appreciated that the pump housing structure 31 can be rotatively adjusted such that the dispenser arm 50 extends about either the front, rear or either side of the rotary floor cleaning machine 10.

Figure 6:
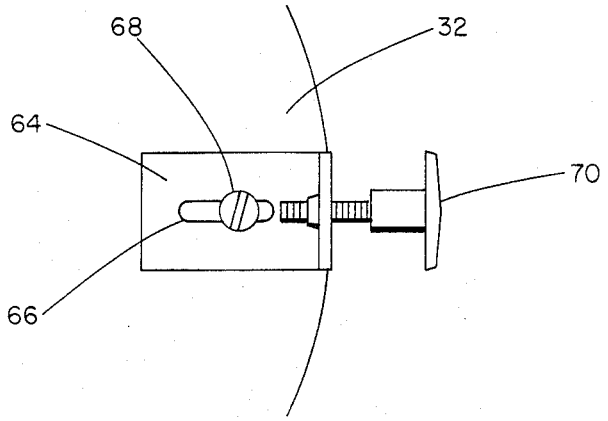
FIG. 6 is a fragmentary bottom view of the dispenser attachment illustrating the adjustable connection means for connecting the same to the rotary floor cleaning machine.

Viewing the adjustable connection means in detail, it is seen that the same comprises a series of brackets 64 secured in circumferential spaced apart relationship about the bottom 32 of pump housing structure 31. As illustrated in FIG. 6, each bracket 34 includes an elongated slot and there is provided a screw 68 that extends through slot 66 securing bracket 64 to the underside of bottom 32. This enables the entire bracket structure to be adjusted inwardly and outwardly with respect to bottom 32. Adjustable screws 70 are threaded into respective brackets 64 and can be moved inwardly and outwardly by screwing the same. Screws 70 act to engage motor housing 18 to retain dispenser attachment 30 about floor machine 10.

In order to control the actuation of pump means 36, there is provided a switch 72 that is designed to be mounted to handle 24 of floor cleaning machine 10. Switch 72 includes a push button 74 that functions to effectively close switch 72 once button 74 is depressed. Operatively connected to switch 72 is an electrical cord 78 that extends therefrom (FIG. 1) into and through the outer wall structure 34 of pump housing structure 31 and is operatively connected to pump means 36 in order that switch 72 may be used to actuate and control the same. In order that switch 72 can be within convenient access of an operator, the same is provided with a mounting clamp 76 which is similar to a hose clamp, and clamp 76 is adapted to be adjustably secured about handle 24.

In operation applicator attachment 30 is designed to be mounted about the top portion of electric motor housing 18. As already noted, applicator attachment 30 is specifically provided with adjustable connection means for allowing the same to be mounted to various sizes or types of motor housings.

To mount applicator attachment 30, bottom 32 is placed adjacent the top of motor housing 30 and the adjustable screws 70 are screwed inwardly to an engaging position. It is noted that prior to actually screwing screws 70 to an engaging position that the entire applicator attachment 30 can be rotated about motor housing 18 to adjust the position of dispenser arm 50 to a desired location. After screws 70 have been screwed inwardly to engage the side wall structure of the motor housing 18, it is appreciated that the entire applicator attachment 30 and pump housing structure 31 is securely held about motor housing 18.

Figure 4:
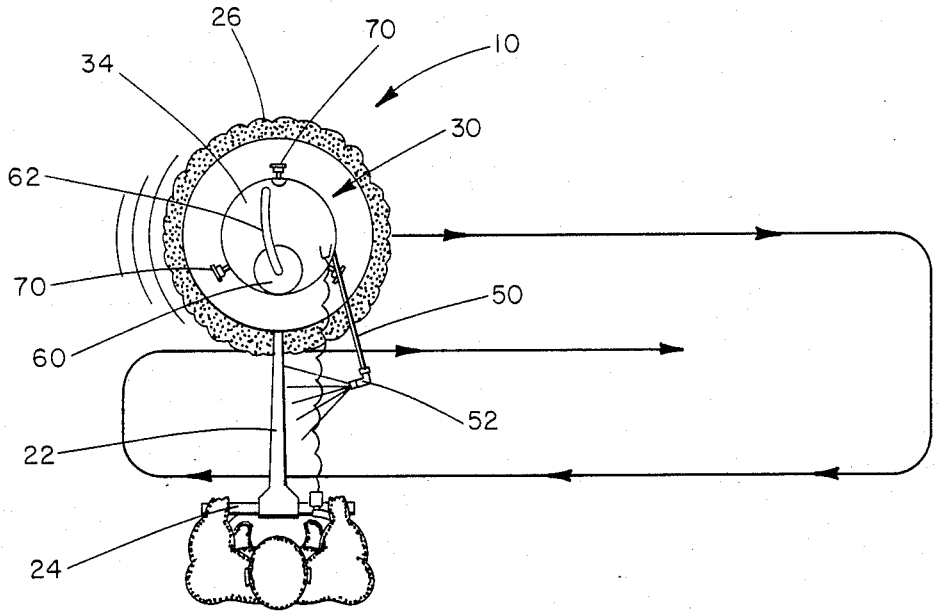
FIG. 4 is a top plan view illustrating a preferred side-to-side method of cleaning with the present invention.
Figure 5:
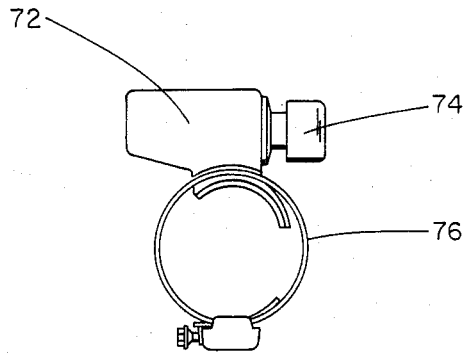
FIG. 5 is a side elevational view of a switch and handle mounting structure for the switch which controls the actual dispensing of cleaning solution from the dispenser attachment of the present invention.

A preferred orientation of dispenser arm 50 and nozzle head 52 is such as shown in FIG. 4 wherein the nozzle head is oriented and directed such that the cleaning solution is sprayed on an area generally behind the wheels 14 of floor cleaning machine 10. As illustrated in FIG. 4, a preferred cleaning technique involves moving the floor cleaning machine and the underlying bonnet pad 26 side to side. Although an operator may develop his or her own technique, in utilizing the present invention, one may find it desirable in cleaning to follow a pattern such as illustrated in FIG. 4. Herein the operator will clean and sweep sideways, stepping back one full step, with no spray as the operator sweeps, and then the operator will move forward one-half step and sweep back with full spray. This basic process is continued throughout the cleaning process.

It is appreciated that the present invention is particularly useful inasmuch as the applicator attachment is designed to fit various types and sizes of rotary floor cleaning machines. Of particular importance is the fact that the applicator attachment can be quickly attached and detached with respect to a motor housing without requiring any type of permanent interconnection between the attachment and the floor cleaning machine.

Also the applicator attachment 30 of the present invention includes its own self-contained container system and, therefore, does not require being operatively connected to an auxiliary and independent tank carried by the floor cleaning machine 10.

During the cleaning operation, the operator can apply cleaning solution on demand and as desired. This greatly improves the overall cleaning efficiency of a rotary floor cleaning machine as the applied solution is always freshly applied in the vicinity where the cleaning operation is actually being carried out and further the cleaning solution is not wasted.

Although the applicator attachment 30 is very effective in cleaning carpet, the same is likewise effective in cleaning hard surfaces. In this regard the applicator attachment can be used on tile and other hard surfaces as a cleaner and applier of finishes. The attachment 30 is especially effective when used with a high speed floor machine which will burnish the surface.

For bonnet cleaning of carpet, the chemical used should dry as quickly as possible, be water soluble, and be an effective cleaner. A mixture of Butyl Cellusolve, surfactants, and water form a very effective cleaning solution. This composition offers a very effective solvency to grease and other soils and evaporates very quickly.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A floor cleaning solution applicator attachment for attachment to an individually propelled rotary floor cleaning machine of the type having a mobile main frame, an electric motor supported by said mobile main frame and having a motor housing structure surrounding the same, a rotary floor cleaning assembly operatively connected and driven by said electric motor and operative to drive a bonnet type cleaner, and a handle assembly operatively connected to said mobile main frame and extending therefrom, said floor cleaning applicator attachment, comprising:

A. a pump housing structure;

B. adjustable connecting means for attaching and detaching said pump housing structure to the top of said electric motor housing structure;

C. electric pump means mounted within said pump housing structure and including an inlet and outlet;

D. container receiving means associated with said pump housing structure for receiving and holding a container;

E. container means for being received by said container receiving means of said pump housing structure in order that said container means may be supported and held by said pump housing structure;

F. connecting line means operatively interconnected between said container means and said inlet of said pump means;

G. dispensing means operatively connected to said outlet of said pump means and extending outwardly from said pump housing structure for dispensing a carpet cleaning solution contained within said container means onto an underlying floor area; and H. on-demand control means adapted to be mounted on said handle assembly of said rotary floor machine for selectively actuating said pump means and dispensing carpet cleaning solution as desired as the rotary floor machine is moved over an area.

2. The floor cleaning solution applicator attachment of claim 1 wherein said pump housing structure includes an outer upper wall structure that includes a container receiving cavity formed therein and wherein said container receiving cavity forms said container receiving means associated with said pump housing structure.

3. The floor cleaning solution applicator attachment of claim 2 wherein said electrical motor housing includes a generally flat top with a cylindrical side wall structure, and wherein said pump housing structure includes a generally flat bottom that is adapted to rest on the top of said electric motor housing; and wherein said adjustable connecting means for connecting said pump housing structure to said electric motor housing comprises a plurality of circumferentially spaced screw type securing means mounted to said pump housing structure, each screw type securing means including a screw that may be screwed inwardly and outwardly relative to said cylindrical side wall structure of said electric motor housing such that said pump housing structure may be secured about said electric motor housing by screwing said screws into engagement with said side wall structure of said electric motor housing and wherein said adjustable connecting means enables said pump housing structure to be mounted on various size electric motor housings.

4. The floor cleaning solution applicator attachment of claim 3 wherein said pump housing structure includes a series of circumferentially spaced brackets secured thereto and wherein said screws of said adjustable connecting means are mounted within said brackets; and wherein there is provided means for adjustably mounting said brackets to said pump housing structure in order that said brackets can be adjustably moved inwardly and outwardly with respect to said electric motor housing in order that said pump housing structure can be made to fit various sizes of electric motor housings.

5. The floor cleaning solution applicator attachment of claim 1 wherein the electric motor housing of said rotary floor cleaning machine includes a top and side wall structure wherein said adjustable connection means for securing said pump housing structure to said electric motor housing comprising a series of brackets secured to said pump housing structure in spaced apart relationship; and a screw member threaded within selected brackets and movable inwardly and outwardly therein and wherein said screws are adapted to be threaded into engagement with the side wall structure of said electric motor housing for securing said pump housing structure to the same.

6. The floor cleaning solution applicator attachment of claim 5 wherein said adjustable connecting means further includes means for adjustably mounting and securing said brackets to said pump housing structure for enabling the same to be adjustably moved inwardly and outwardly in order to accommodate electric motor housings of various sizes.

7. The floor cleaning solution applicator attachment of claim 1 wherein said dispensing means includes an elongated dispensing line having an outer remote end and operatively connected to the outlet of said pump means; a nozzle head secured to the outer remote end of said elongated dispensing line; and means for adjustably connecting said nozzle head to the outer remote end of said dispensing line such that orientation of said nozzle head may be adjusted with respect to said dispensing line.

8. The floor cleaning solution applicator attachment of claim 7 wherein said dispensing means is provided with a ball joint connector operatively interconnected between said outlet of said pump means and said dispensing line for allowing said dispensing line to be pivoted or moved via said ball joint connector wherein said ball joint connector generally prevents said dispensing means from being damaged due to the same being inadvertently hit or struck by an object or obstacle while said floor cleaning machine is being moved over an area.

9. The floor cleaning solution applicator attachment of claim 1 wherein said on-demand control means includes switch means, means for mounting said switch means to said handle assembly of said rotary floor cleaning machine, and wherein said switch means is operatively connected to said pump means for actuating said pump means as desired as said floor cleaning machine is moved over an area.

10. An attachment adapted to be mounted to a rotary floor cleaning machine having an electric motor housing with a top and side wall structure and wherein said attachment is adapted to dispense a cleaning solution as the rotary floor cleaning machine is moved over an area to be cleaned, said attachment comprising:

A. pump means having an inlet and an outlet;

B. a pump housing structure enclosing said pump means and including a bottom and an outer wall structure that extends upwardly from said bottom for enclosing said pump means;

C. said outer wall structure of said pump housing structure including a cavity formed therein for receiving, holding and supporting a container;

D. container means normally held and supported within said formed cavity means;

E. conduit means interconnecting said container means with said inlet of said pump means;

F. dispensing means operatively connected to said outlet of said pump means and extending outwardly therefrom and projecting outwardly from said pump housing structure;

G. adjustable connecting means associated with said pump housing structure for enabling said pump housing structure to be mounted to electric motor housings of different sizes and for adjusting and varying the position of said dispensing means with respect to said rotary floor cleaning machine, said adjustable connecting means including a series of spaced apart brackets secured to said pump housing structure and depending downwardly below said bottom; and H. adjustable securing means movably mounted within said brackets and movable between an outer non-engaged position outwardly of the side wall structure of said electric motor housing and an inner engaged position where said adjustable securing means engages the side wall structure of said electric motor housing so as to secure said housing structure to said electric motor housing whereby said adjustable securing means enables said pump housing structure to be easily attached and detached to and from electric motor housings of various sizes and wherein said adjustable securing means further allows said pump housing structure to be rotatively varied about said electric motor housing such that said dispensing means can be selectively positioned to dispense a cleaning solution at various points about said rotary floor cleaning machine.

* * * * *